US008216398B2

(12) United States Patent
Bledsoe et al.

(10) Patent No.: US 8,216,398 B2
(45) Date of Patent: Jul. 10, 2012

(54) METHOD FOR CONTROLLING PHASE TRANSFORMATION TEMPERATURE IN METAL ALLOY OF A DEVICE

(75) Inventors: John Gary Bledsoe, St. Louis, MO (US); Berton Roy Moed, St. Louis, MO (US); Dongfa Li, East Amherst, NY (US)

(73) Assignee: Saint Louis University, St. Louis, MO (US)

( * ) Notice: Subject to any disclaimer, the term of this patent is extended or adjusted under 35 U.S.C. 154(b) by 113 days.

(21) Appl. No.: 12/781,017

(22) Filed: May 17, 2010

(65) Prior Publication Data

US 2011/0277890 A1 Nov. 17, 2011

Related U.S. Application Data

(63) Continuation-in-part of application No. 11/576,452, filed on May 18, 2010.

(51) Int. Cl.
*C22F 1/10* (2006.01)

(52) U.S. Cl. ..... 148/563; 148/676

(58) Field of Classification Search ..... None
See application file for complete search history.

(56) References Cited

U.S. PATENT DOCUMENTS

| | | | | |
|---|---|---|---|---|
| 5,415,660 | A | 5/1995 | Campbell et al. | |
| 5,843,244 | A * | 12/1998 | Pelton et al. | 148/563 |
| 6,127,597 | A | 10/2000 | Beyar et al. | |
| 6,626,937 | B1 * | 9/2003 | Cox | 623/1.18 |
| 6,783,530 | B1 | 8/2004 | Levy | |
| 2002/0177866 | A1 | 11/2002 | Weikel et al. | |
| 2003/0181918 | A1 | 9/2003 | Smothers et al. | |
| 2004/0216816 | A1 * | 11/2004 | Wojcik | 148/675 |
| 2007/0289677 | A1 * | 12/2007 | Ma et al. | 148/563 |

* cited by examiner

*Primary Examiner* — George Wyszomierski
(74) *Attorney, Agent, or Firm* — Husch Blackwell LLP

(57) ABSTRACT

An efficient method to reduce product wastes due to inaccurate transformation temperatures for shape memory products and parts, which provides a useful method for optimizing shape memory alloys phase transformation temperatures and mechanical properties by using heat treatment procedures below 250 degrees C. for extended dwell times.

8 Claims, 4 Drawing Sheets

METHOD FOR CONTROLLING PHASE TRANSFORMATION TEMPERATURE IN METAL ALLOY OF A DEVICE

CROSS REFERENCE

This application is a continuation-in-part of U.S. patent application entitled INTRAMEDULLARY NAIL DEVICE AND METHOD FOR REPAIRING LONG BONES, May 18, 2010 having application Ser. No. 11/576,452, which is hereby incorporated by reference in its entirety herein.

BACKGROUND OF INVENTION

1. Field of Invention

This invention relates generally to controlling the phase transformation temperature of a metal alloy and, more particularly, to heat treatment to control the phase transformation temperature.

2. Background Art

In one area of metallurgy, there has been great interest in the field of shape memory and super-elastic alloys known as nickel-titanium. A nickel-titanium alloy, also known as nitinol (i.e., Nickel-Titanium Naval Ordinance Laboratory), is made from a nearly equal composition of nickel and titanium. The performance of nitinol alloys is often based on the phase transformation in the crystalline structure, which transitions between an austenitic phase and a martensitic phase. The austenitic phase is called the high temperature phase, while the martensitic phase is referred to as the low temperature phase. It is understood that the phase transformation is the mechanism for achieving super-elasticity and the shape memory effect.

Austenite (or gamma phase iron) is a metallic non-magnetic allotrope of iron or a solid solution of iron, with an alloying element. In plain-carbon steel, austenite exists above the critical eutectoid temperature of 1000 K (about 727° C.); other alloys of steel have different eutectoid temperatures. Above 912° C. and up to 1394° C. alpha iron undergoes a phase transition from body-centred cubic to the face-centred cubic configuration of gamma iron, also called austenite. This is similarly soft and ductile but can dissolve considerably more carbon (as much as 2.04% by mass at 1146° C.). This gamma form of iron is exhibited by the most commonly used type of stainless steel for making hospital and food-service equipment.

Austenitization means to heat the iron, iron-based metal, or steel to a temperature at which it changes crystal structure from ferrite to austenite. An incomplete initial austenitization can leave undissolved carbides in the matrix. For some irons, iron-based metals, and steels, the presence of carbides may occur or be present during the austenitization step. The term commonly used for this is two-phase austenitization. Austempering is a hardening process that is used on iron-based metals to promote better mechanical properties. The metal is heated into the austenite region of the iron-cementite phase diagram and then quenched in a "salt bath" or heat extraction medium that is between temperatures of 300-375° C. (572-707° F.). The metal is annealed in this temperature range until the austenite turns to bainite or ausferrite (bainitic ferrite+high-carbon austenite). By changing the temperature for austenitization, the austempering process can yield different and desired microstructures. A higher austenitization temperature can produce a higher carbon content in austenite, whereas a lower temperature produces a more uniform distribution of austempered structure. The carbon content in austenite as a function of austempering time has been established. As austenite cools, it often transforms into a mixture of ferrite and cementite as the carbon diffuses.

Depending on alloy composition and rate of cooling, pearlite may foam. If the rate of cooling is very fast, the alloy may experience a large lattice distortion known as martensitic transformation, instead of transforming into ferrite and cementite. In this industrially very important case, the carbon is not allowed to diffuse due to the cooling speed, resulting in a BCT-structure. The result is hard martensite. The rate of cooling determines the relative proportions of these materials and therefore the mechanical properties (e.g., hardness, tensile strength) of the steel. Quenching (to induce martensitic transformation), followed by tempering will transform some of the brittle martensite into tempered martensite. If a low-hardenability steel is quenched, a significant amount of austenite will be retained in the microstructure.

Martensite most commonly refers to a very hard form of steel crystalline structure, but it can also refer to any crystal structure that is formed by displacive transformation. It includes a class of hard minerals occurring as lath- or plate-shaped crystal grains. When viewed in cross-section, the lenticular (lens-shaped) crystal grains appear acicular (needle-shaped), which is how they are sometimes incorrectly described. One of the differences between the two phases is that martensite has a body centered tetragonal crystal structure, whereas austenite has a face center cubic (FCC) structure. The transition between these two structures requires very little thermal activation energy because it is a martensitic transformation, which results in the subtle but rapid rearrangement of atomic positions, and has been known to occur even at cryogenic temperatures. Martensite has a lower density than austenite, so that the martensitic transformation results in a relative change of volume.

Since chemical processes (the attainment of equilibrium) accelerate at higher temperature, martensite is easily destroyed by the application of heat. This process is called tempering. The martensite is formed by rapid cooling (quenching) of austenite which traps carbon atoms that do not have time to diffuse out of the crystal structure. This martensitic reaction begins during cooling when the austenite reaches the martensite start temperature ($M_s$) and the parent austenite becomes mechanically unstable. At a constant temperature below $M_s$, a fraction of the parent austenite transforms rapidly, then no further transformation will occur. When the temperature is decreased, more of the austenite transforms to martensite. Finally, when the martensite finish temperature ($M_f$) is reached, the transformation is complete In some alloys, the effect is reduced by adding elements such as tungsten that interfere with cementite nucleation, but, more often than not, the phenomenon is exploited instead. Since quenching can be difficult to control, many steels are quenched to produce an overabundance of martensite, then tempered to gradually reduce its concentration until the right structure for the intended application is achieved. Too much martensite leaves steel brittle, too little leaves it soft.

Heating white hypereutectic cast iron above 730° C. causes the formation of austenite in crystals of primary cementite. This austenitization of white iron occurs in primary cementite at the interphase boundary with ferrite. When the grains of austenite form in cementite, they occur as lamellar clusters oriented along the cementite crystal layer surface. Austenite is formed by withdrawal of carbon atoms from cementite into ferrite. The addition of certain alloying elements, such as manganese and nickel, can stabilize the austenitic structure, facilitating heat-treatment of low-alloy steels. In the extreme case of austenitic stainless steel, much higher alloy content makes this structure stable even at room temperature. On the other hand, such elements as silicon, molybdenum, and chromium tend to de-stabilize austenite, raising the eutectoid temperature.

Austenite is only stable above 910° C. in bulk metal form. However, the use of a face-centered cubic (fcc) or diamond cubic substrate allows the epitaxial growth of fcc transition metals. The epitaxial growth of austenite on the diamond (100) face is feasible because of the close lattice match and the symmetry of the diamond (100) face is fcc. More than a monolayer of γ-iron can be grown because the critical thickness for the strained multilayer has been determined and is in close agreement with theory.

Shape memory implies that the alloy can be in-elastically deformed into a particular shape in the martensitic phase, and when heated to the austenitic phase, the alloy transforms back to its remembered shape. Super-elasticity or pseudo-elasticity refers to the highly elastic capability of the alloy when placed under stress and without involvement of heat. Based on super-elastic properties, it is possible to see reversible strains of up to 8 percent elongation in a super-elastic nitinol wire as compared to 0.5 percent reversible strain in, for example, a steel wire of comparable size. The super-elastic property appears in the austenitic phase when stress is applied to the alloy and the alloy changes from the austenitic phase to the martensitic phase. This particular martensitic phase is more precisely known as stress-induced martensite or SIM, which phase is unstable at temperatures above a phase transformation temperature and below the temperature known as M.sub.d. At temperatures above M.sub.d, it is no longer possible to stress-induce martensite, so it is known as the temperature at which there is a loss of super-elasticity. Within this temperature range, however, if the applied stress is removed, the stress-induced martensite reverts back to the austenitic phase. It is this phase change that enables the characteristic recoverable strains achieved in super-elastic nitinol.

Nitinol alloys exhibit both super-elasticity and the shape memory effect. Some skilled in the art have developed processing techniques to enhance these valuable properties. Those processing techniques include changing the composition of nickel and titanium, alloying the nickel-titanium with other elements, heat treating the alloy, and mechanical processing of the alloy. In recent times, super-elastic nickel-titanium alloys have been applied to self-expanding stents and other medical devices. Nitinol has also been used in guide wires, cardiac pacing leads, sutures, prosthetic implants such as stents mentioned above, intra-luminal filters, and tools deployed through a cannula, to name a few.

As discussed above, Nitinol, a class of nickel-titanium alloys, is well known for its shape memory properties. As a shape memory material, nitinol is able to undergo a reversible thermo-elastic transformation between certain metallurgical phases. Generally, the thermo-elastic shape memory effect allows the alloy to be shaped into a first configuration while in the relative high-temperature austenite phase, cooled below a transition temperature or temperature range at which the austenite transforms to the relative low-temperature martensite phase, and deformed while in the martensitic state into a second configuration. When heated, the material returns to austenite such that the alloy transforms in shape from the second configuration to the first configuration. The thermo-elastic effect is often expressed in terms of the following transition temperatures: M.sub.s, the temperature at which austenite begins to transform to martensite upon cooling; M.sub.f, the temperature at which the transformation from austenite to martensite is complete; A.sub.s, the temperature at which martensite begins to transform to austenite upon heating; and A.sub.f, the temperature at which the transformation from martensite to austenite is complete.

The transformation from austenite to martensite on cooling begins at a temperature known as the M.sub.s temperature, and is completed at a temperature known as the M.sub.f temperature. The transformation of martensite to austenite upon heating begins at a temperature known as the A.sub.s temperature and is complete at a temperature known as the A.sub.f temperature. The application of a load tends to favour, or stabilize the martensite phase. Non-linear super-elastic properties are exhibited when the austenitic phase is stable in the absence of a load, yet the martensitic phase can temporarily become the stable phase when a load of sufficient magnitude is introduced. Thus these properties require that one maintains the material temperature slightly above the A.sub.f temperature. The temperature above which all traces of super-elasticity are lost is called the M.sub.d temperature.

A binary Ti—Ni alloy which is widely used as a shape memory alloy has defects because its phase transformation temperature greatly depends upon its composition and its heat treatment temperature and is lower than ambient temperature when a large output force is attempted to be obtained. Thus, a difficulty is encountered in controlling the composition. The prior art makes reference to the use of alloys such as NITINOL (Ni—Ti alloy) which have shape memory and/or super-elastic or pseudo-elastic characteristics in medical devices which are designed to be inserted into a patient's body. The shape memory characteristics allow the prior art devices to be deformed while in the martensite phase to facilitate their insertion into a body lumen or cavity and then be heated within the body due to body temperature to transform the metal to the austenite phase so that the device returns to its remembered shape. Super-elastic characteristics on the other hand generally allow the metal to be deformed and restrained in the deformed condition to facilitate the insertion of the medical device containing the metal into a patient's body, with such deformation causing the phase transformation, e.g. austenite to martensite. Once within the body lumen the restraint on the super-elastic member can be removed, thereby reducing the stress therein so that the super-elastic member can return to its original un-deformed shape by the transformation back to the original austenite phase. In other applications, the stress induced austenite to martensite transformation is utilized to minimize trauma while advancing a medical device such as a guide-wire within a patient's body lumen. However, developing an alloy that will change based on body temperature can be difficult to achieve using standard heat treatment procedures with a level of accuracy and consistency.

As discussed above, alloys which have shape memory/super-elastic characteristics generally have at least two phases, a martensite phase, which has a relatively low strength and which is stable at relatively low temperatures, and an austenite phase, which has a relatively high strength and which is stable at temperatures higher than the martensite phase. For use in the human body, shape memory characteristics are imparted to the alloy by heating the metal at a temperature above body temperature, preferably between about 40.degree. to about 60.degree. C. while the metal is kept in a constrained shape and then cooled to ambient temperature. The cooling of the alloy to ambient temperature causes at least part of the austenite phase to transform to the martensite phase which is more stable at this temperature. The constrained shape of the metal during this heat treatment is the shape "remembered" when the alloy is reheated to these temperatures causing the transformation of the martensite phase to the austenite phase. The metal in the martensite phase may be plastically defaulted to facilitate the entry thereof into a patient's body. The metal will remain in the "remembered" shape even when cooled to a temperature below the transformation temperature back to the martensite phase, so it must be reformed into a more usable shape, if necessary. Subsequent heating of the deformed martensite phase to a temperature above the martensite to austenite transformation temperature causes the deformed martensite phase to transform to the austenite phase and during this phase transformation the metal reverts back to its remembered shape.

Articles formed from shape memory alloys can exhibit shape memory properties associated with transformations between martensite and austenite phases of the alloys. These properties include thermally induced changes in configuration in which an article is first deformed from a heat-stable configuration to a heat-unstable configuration while the alloy is in its martensite phase. Subsequent exposure to increased temperature results in a change in configuration from the heat-unstable configuration towards the original heat-stable configuration as the alloy reverts from its martensite phase to its austenite phase.

The prior methods of using the shape memory characteristics of these alloys in medical devices intended to be placed within a patient's body presented operational difficulties. For example, with shape memory alloys having a martensite phase which is stable at a temperature below body temperature, it was frequently difficult to maintain the temperature of the medical device containing such an alloy sufficiently below body temperature to prevent the transformation of the martensite phase to the austenite phase when the device was being inserted into a patient's body. With intravascular devices formed of shape memory alloys having martensite-to-austenite transformation temperatures well above body temperature, the devices could be introduced into a patient's body with little or no problem, but they usually had to be heated to the martensite-to-austenite transformation temperature which was frequently high enough to cause tissue damage and very high levels of pain.

When stress is applied to a specimen of a metal such as NITINOL exhibiting super-elastic characteristics at a temperature at or above which the transformation of martensite phase to the austenite phase is complete, the specimen deforms elastically until it reaches a particular stress level where the alloy then undergoes a stress-induced phase transformation from the austenite phase to the martensite phase. As the phase transformation proceeds, the alloy undergoes significant increases in strain but with little or no corresponding increases in stress. The strain increases while the stress remains essentially constant until the transformation of the austenite phase to the martensite phase is complete. Thereafter, further increase in stress is necessary to cause further deformation. The martensitic metal first yields elastically upon the application of additional stress and then plastically with permanent residual deformation.

Precise control of a shape memory alloy's transformation temperatures is the key factor for successful application of most shape memory alloys. Methods of adjusting or tuning the phase transformation temperatures include change of chemical composition, controlling the amount of cold work introduced in the materials during processing and following heat treatment. For shape memory alloy products and parts such as medical devices, heat treatment is the primary method. However, it is difficult to obtain precise and consistent control transformation temperatures using traditional heat treatment method. A better process is needed particularly for medical devices used in the human body where the transformation temperature is that of the human body.

BRIEF SUMMARY OF INVENTION

The invention is a novel method for tuning or controlling the phase transformation temperatures and mechanical properties of nickel-titanium based shape memory alloys (especially Nitinol) more accurately and consistently. The present invention provides an efficient method to reduce product wastes due to inaccurate transformation temperatures for shape memory products and parts. In addition, this invention provides a useful method for optimizing shape memory alloys phase transformation temperatures and mechanical properties. As discussed above, precise control of a shape memory alloy's transformation temperatures is the key factor for successful application of most shape memory alloys.

Methods of adjusting or tuning the phase transformation temperatures include change of chemical composition, controlling the amount of cold work introduced in the materials during processing and following heat treatment. For shape memory alloy products and parts such as medical devices, heat treatment is the primary method. To those skilled in the art, there are various heat treatment procedures to control nickel-titanium based shape memory alloys transformation temperatures, and most skilled in the art would utilize heat treatment procedures above 250 degrees C., with a duration time from minutes to several hours. For Nitinol, typical heat treatment is in the temperature range from about approximately 325 degrees C.-to-525 degrees C. for five (5) to thirty (30) minutes. Generally, for those skilled in the art, for shape memory alloys that are being heat treated, it is easy to further raise phase transformation temperatures by an increase in heat treatment temperature and/or increase in the holding time, while there are not many efficient methods to further decrease phase transformation temperatures.

With the present invention, an effective heat treatment procedure is provided by treating shape memory alloys at temperatures below 250 degrees C. (more preferably between 150 and 200 degrees C.), with different duration of holding time, which depends on final requirements of the material. The novel procedure is a successive process of heat treatment, but makes the heat treatment more flexible in order to meet specific application requirement. For example, if plasticity is required for the material, higher temperature can be applied (which will result in higher transformation temperatures).

One embodiment of the procedure is to utilize a Ni—Ti shape memory alloy with a composition of 49.5 at. % Ni. and 50.5 at. % Ti. A typical procedure would be after cold working and heat treatment at 550 degrees C. for 60 minutes and 550 degrees C. for 90 minutes, the austenite finish temperature Af is 43 degrees C. and 44 degrees C. respectively. However, by using the present invention's new procedure having a new temperature at 180 degrees C. up to 42 hours, the Af can be decreased to 29 degrees C. and 36 degrees C., respectively. Another typical procedure is that after cold working and heat treatment at 800 degrees C. for 20 minutes (by such treatment, the material becomes soft enough), and then at 500 degrees C. for 30 minutes and 90 minutes, to establish an Af temperature that is 47 degrees C. and 50 degrees C. respectively. However, by using the present invention's novel procedure, at 118 degrees C. for 11 Days, the Af temperatures can be reduced to 35 degrees C. and 36 degrees C. respectively. The present invention is novel and is contrary to conventional wisdom which teaches the use of must higher temperatures during heat treatment. The present invention will allow the transition temperatures of Nitinol alloys to be accurately and consistently adjusted in the range of the human body temperature, and the mechanical properties can also be tuned at the same time. The process has specific utility for the use of nickel-titanium based medical devices or components used in the human body.

These and other advantageous features of the present invention will be in part apparent and in part pointed out herein below.

BRIEF DESCRIPTION OF THE DRAWINGS

For a better understanding of the present invention, reference may be made to the accompanying drawings in which.

Figure 1:
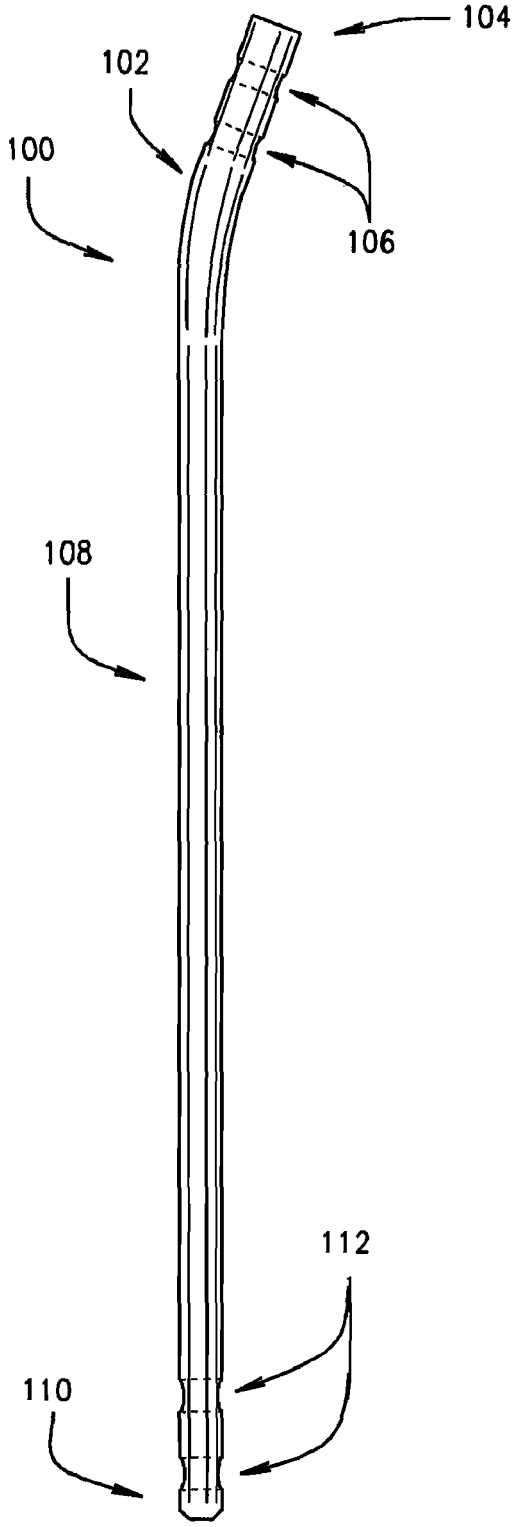
FIG. 1 is an illustration of the device structure prior deformation.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF INVENTION

According to the embodiment(s) of the present invention, various views are illustrated in FIG. 1-6 and like reference numerals are being used consistently throughout to refer to like and corresponding parts of the invention for all of the various views and figures of the drawing. Also, please note that the first digit(s) of the reference number for a given item or part of the invention should correspond to the FIG. number in which the item or part is first identified.

One embodiment of the present invention comprising heat treatment process for treating an alloy in order to achieve a desired transformation temperature teaches a novel method for treating an alloy utilized in a product or device such as a medical device. With the present invention, an effective heat treatment procedure is provided by treating shape memory alloys at temperatures below 250 degrees C. (more preferably between 150 and 200 degrees C.), with different duration of holding time, which depends on final requirements of the material. The novel procedure is a successive process of heat treatment, but makes the heat treatment more flexible in order to meet specific application requirement. For example, if plasticity is required for the material, higher temperature can be applied (which will result in higher transformation temperatures).

One embodiment of the procedure is to utilize a Ni—Ti shape memory alloy with a composition of 49.5 at. % Ni. and 50.5 at. % Ti. A procedure would be after cold working and heat treatment at 550 degrees C. for 60 minutes and 550 degrees C. for 90 minutes, the austenite finish temperature Af is 43 degrees C. and 44 degrees C. respectively. The present invention's procedure includes a new temperature at 180 degrees C. up to 42 hours, the Af can be decreased to 29 degrees C. and 36 degrees C., respectively. Another procedure is that after cold working and heat treatment at 800 degrees C. for 20 minutes (by such treatment, the material becomes soft enough), and then at 500 degrees C. for 30 minutes and 90 minutes, to establish an Af temperature that is 47 degrees C. and 50 degrees C. respectively. By using the present invention's procedure, an additional heat treatment is applied at 118 degrees C. for 2 Days or alternatively at 150 degrees C. for 11 days, the Af temperatures can be reduced to 35 degrees C. and 36 degrees C. respectively. The present invention is novel and is contrary to conventional wisdom which teaches the use of must higher temperatures during heat treatment. The present invention will allow the transition temperatures of Nitinol alloys to be accurately and consistently adjusted in the range of the human body temperature, and the mechanical properties can also be tuned at the same time. The process has specific utility for the use of nickel-titanium based medical devices or components used in the human body.

Figure 5:
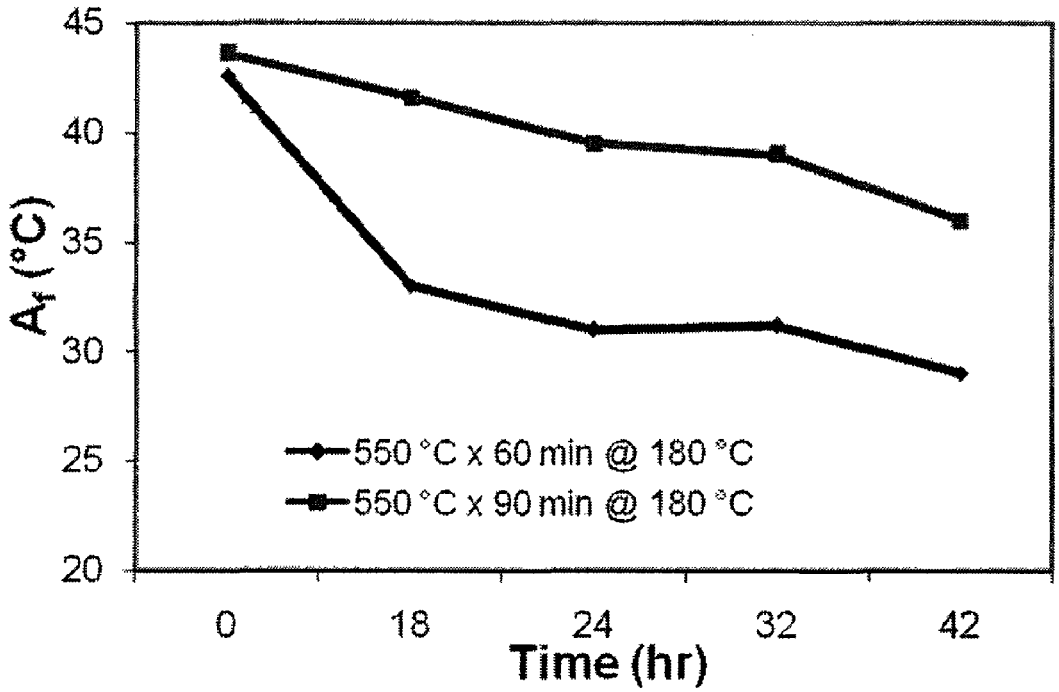
FIG. 5 is a graphical illustration of heat treatment profiles at 180 degrees C.

The details of the invention and various embodiments can be better understood by referring to the figures of the drawing. Referring to FIG. 5, a graphical illustration of heat treatment profiles at 180 degrees C. is shown. The shape memory alloy material (a Ni—Ti shape memory alloy with a composition of about approximately 49.5 at. % Ni. and about approximately 50.5 at. % Ti) can be manufactured using metallurgical processes of melting, hot forging and rolling. Raw materials such as sponge Ti and Ni pellets can be melted at about approximately 1,300 to about approximately 1,600 degrees C. by melting in a furnace such as a high frequency vacuum induction melting furnace, arc melting furnace, or plasma melting furnace or the like. The material can be forged and rolled as appropriate. The material can then be formed into a primary product through cold working the material. Through cold working the shape and size of the material can be altered by plastic deformation or the increase of dislocation density. The process can include rolling, drawing, pressing, bending, spinning, extruding, shearing and heading and it is carried out below the re-crystallization point usually at room temperature. Hardness and tensile strength are increased with the degree of cold work while ductility and impact values are lowered. The primary product can be machined to the final product. After cold working the alloy can be heat treated as reflected where precipitation, recovery and re-crystallization occurs. Heat treatments that provide the thermal energy required for precipitation can also activate the processes of annealing during which the rearrangement of defects and the decrease in defect density reduce the stored strain energy in the alloy. As reflected by the graphical illustration a heat treatment is applied at about approximately 550 degrees C. for about approximately 60 minutes or alternatively at about approximately 550 degrees C. for about approximately 90 minutes. After this first step in the heat treatment process, the austenite finish temperature Af is about approximately 43 degrees C. and about approximately 44 degrees C. respectively. The present invention's heat treatment procedure includes applying a new temperature at about approximately 180 degrees C. up to 42 hours, whereby the Af can be decreased to 29 degrees C. and 36 degrees C., respectively.

Figure 6:
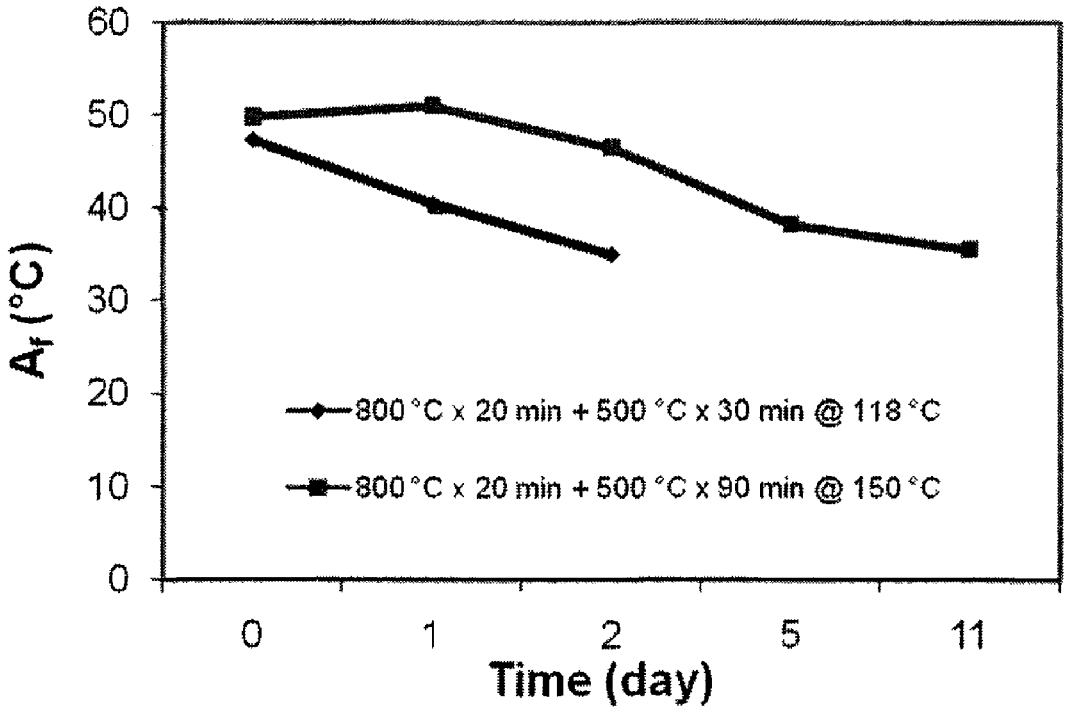
FIG. 6 is a graphical illustration of heat treatment profiles at 118 and 150 degrees C.

Referring to FIG. 6 a graphical illustration of alternative heat treatment profiles at 118 and 150 degrees C. are shown. As illustrated in the graphical representation, after cold working, a heat treatment can be applied at about approximately 800 degrees C. for 20 minutes (by such treatment, the material becomes soft enough), and then the alloy is heat treated at about approximately 500 degrees C. for 30 minutes or alternatively 90 minutes, to establish an Af temperature that is 47 degrees C. and 50 degrees C. respectively. However, the present invention includes an additional heat treatment procedure, at about approximately 118 degrees C. for 2 Days or alternatively at 150 degrees C. for 11 days, the Af temperatures can be reduced to 35 degrees C. and 36 degrees C. respectively. Other alternative steps for low temperature—long dwell time heat treatments are as follows:

(Annealing temperature, time; second treatment temperature, time; and third treatment, time; $A_f$)

(800° C., 10 minutes; 600° C., 30 minutes; 150° C., 65 hours; 36° C.)

(800° C., 10 minutes; 600° C., 30 minutes; 150° C., 118 hours; 33° C.)

(800° C., 20 minutes; 500° C., 30 minutes; 118° C., 46 hours; 35° C.)

(800° C., 20 minutes; 600° C., 30 minutes; 118° C., 42 hours; 35° C.)

The present invention is a heat treatment method that uses lower than standard temperatures for such a process and longer dwell times for the lower temperature. The process can be a two step heat treatment process or a one step heat treatment process as shown above. The present invention is a departure from standard high temperature heat treatment processes. The present low temperature process can utilize a low temperature treatment phase following a high temperature heat treatment phase where the low temperature falls within the range of about approximately 100° C. to about approximately 200° C. with an approximate dwell time or duration that falls within the range of about approximately 40 hours to about approximately 15 days.

Referring to FIG. 1, an illustration of the device structure prior deformation is shown. The illustration is representative of an elongated rod shaped intramedullary device 100 for insertion in a bone structure. The device 100 has a slight bend 102 proximate the top end 104. The top end 104 has two upper through-holes 106 for anchoring the device after insertion. The lower portion 108 of the device 100 is substantially straight in its first configuration. The bottom end 110 of the lower portion 108 has two lower through-holes 112 for anchoring the device after insertion.

Figure 2:
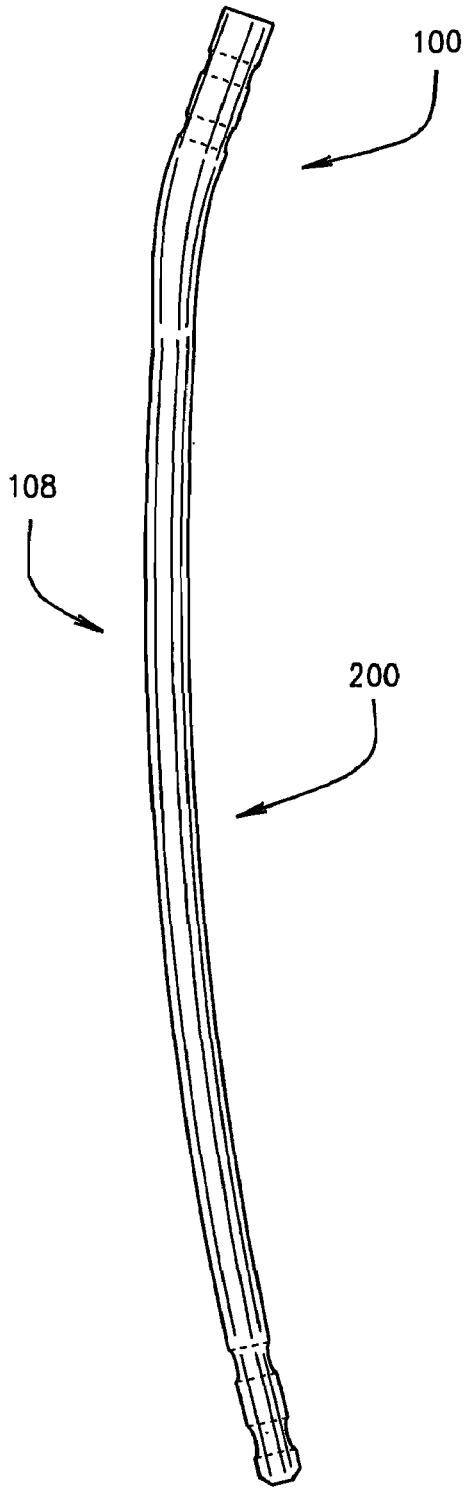
FIG. 2 is an illustration of the device after deformation for ease of insertion.

Referring to FIG. 2, an illustration of the device 100 after deformation for ease of insertion is shown. The lower portion 108 is deformed with a curvature 200 for ease of insertion.

Figure 3:
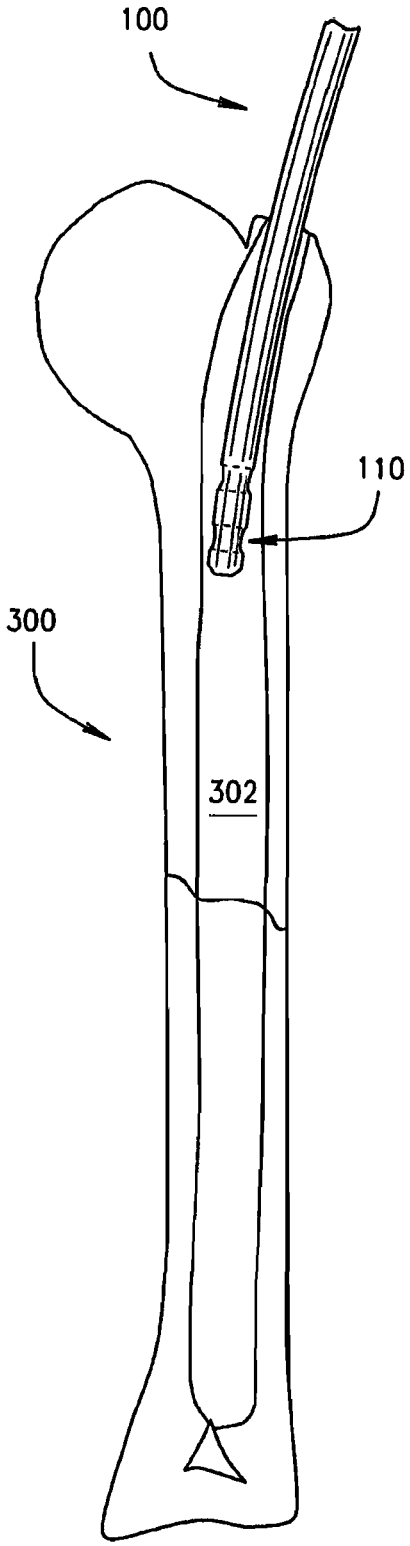
FIG. 3 is an illustration of a representative device having been deformed for ease of insertion and being inserted in the bone structure.

Referring to FIG. 3, an illustration of a representative device 100 having been deformed with a curvature 200 for ease of insertion and being inserted in the bone structure 300 is shown. The bone structure has an elongated hole 302 drilled therein for insertion of the device 100. The device 100, is shown being inserted in the elongated hole 302.

Figure 4:
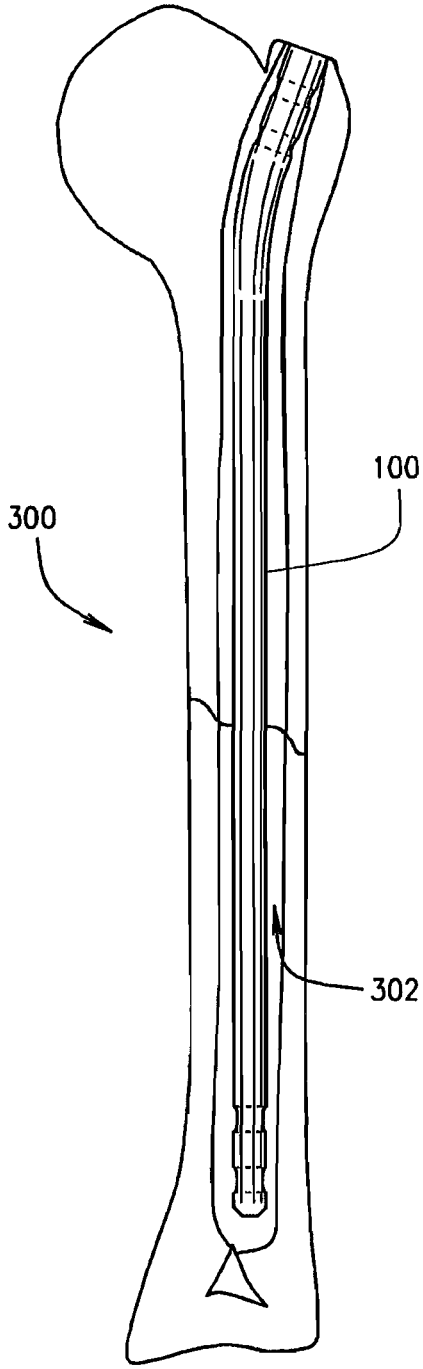
FIG. 4 is an illustration of a representative device having been fully inserted and taking on the shape of the bone structure.

Referring to FIG. 4, an illustration of a representative device 100 having been fully inserted in the elongated hole 302 and taking on the shape of the bone structure is shown.

One embodiment of the present invention is A heat treatment process for lowering the transformation temperature of an alloy comprising the steps of providing a shape memory alloy forged into a preliminary structure and at least 25% cold working the preliminary structure into a primary product. The method further comprising the steps of high temperature heat treating the primary product formed in shape to a first configuration for a duration of less than 120 minutes and establishing a preliminary $A_f$, and low temperature heat treating the primary product formed in shape to said first configuration for a duration of greater than 40 hours and establishing a final $A_f$ lower than said preliminary $A_f$. The heat treatment process can be performed on a shape memory alloy that has a composition of between about approximately 40.0 to 49.5 at. % Ni. and between about approximately 60.0 to 50.5 at. % Ti. The high temperature heat treating can include treating at a temperature between about approximately 500 to 600° C. and for a duration between 50 to 120 minutes. The low temperature heat treating can include treating at a temperature between about approximately 150 to 200° C. for a duration of between about approximately 36 to 45 hours. The process can further include the steps of deforming the primary product for ease of insertion in a human body, inserting the deformed primary product into the bone structure within the human body, and allowing the internal human body temperature to return the deformed primary product formed in shape to the first configuration.

Another embodiment of the present invention is a heat treatment process for lowering the transformation temperature of an alloy comprising the steps of providing a shape memory alloy forged into a preliminary structure and at least 25% cold working the preliminary structure into a primary product. The process further comprising the step of high temperature heat treating the primary product formed in shape to a first configuration for a duration of less than 120 minutes and establishing a preliminary $A_f$, and low temperature heat treating the primary product formed in shape to said first configuration for a duration of greater than 40 hours and establishing a final $A_f$ lower than said preliminary $A_f$.

The heat treatment process can be performed on a device made of a shape memory alloy that has a composition of between about approximately 40.0 to 49.5 at. % Ni. and between about approximately 60.0 to 50.5 at. % Ti. The high temperature heat treating can include treating at a temperature between about approximately 750 to 850° C. for a duration of between about approximately 15 to 25 minutes and treating at a temperature between about approximately 450 to 550° C. for a duration of between about approximately 30 to 90 minutes. The low temperature heat treating can include treating at a temperature between about approximately 110 to 150° C. for a duration between 48 hours and 15 days. The heat treatment process can further comprise deforming the primary product for ease of insertion in a bone structure within a human body, inserting the deformed primary product into the human body, and allowing the internal human body temperature to return the deformed primary product formed in shape to the first configuration.

The various heat treatment examples shown above illustrate a novel heat treatment method for an alloy and method for using devices undergoing such treatment in the bone structure within the human body. A user of the present invention may choose any of the above heat treatment procedures, or an equivalent thereof, depending upon the desired application. In this regard, it is recognized that various forms of the subject heat treatment procedure could be utilized without departing from the spirit and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A heat treatment process for lowering the transformation temperature of an alloy comprising the steps of:

providing a shape memory alloy forged into a preliminary structure and at least 25% cold working the preliminary structure into a primary product;

high temperature heat treating the primary product formed in a shape of a first configuration for a duration of less than 120 minutes and establishing a preliminary $A_f$; and low temperature heat treating the primary product formed in the shape of said first configuration for a duration of greater than 40 hours and establishing a final $A_f$ lower than said preliminary $A_f$.

2. The heat treatment process as recited in claim 1, where said shape memory alloy is a composition of between 40.0 to 49.5 at. % Ni. and between 60.0 to 50.5 at. % Ti .

3. The heat treatment process as recited in claim 2, where the high temperature heat treating includes treating at a temperature between 500 to 600° C. and for a duration between 50 to 120 minutes.

4. The heat treatment process as recited in claim 3, where the low temperature heat treating includes treating at a temperature between 150 to 200° C. for a duration of between 36 to 45 hours.

5. The heat treatment process as recited in claim 4, further comprising the steps of:

deforming the primary product for ease of insertion in a human body;

inserting the deformed primary product into the human body; and allowing the internal human body temperature to return the deformed primary product to the first configuration.

6. The heat treatment process as recited in claim 2, where the high temperature heat treating includes treating at a temperature between 750 to 850° C. for a duration of between 15 to 25 minutes and treating at a temperature between 450 to 550° C. for a duration of between 30 to 90 minutes.

7. The heat treatment process as recited in claim 6, where the low temperature heat treating includes treating at a temperature between 110 to 150° C. for a duration between 48 hours and 15 days.

8. The heat treatment process as recited in claim 7, further comprising the steps of:

deforming the primary product for ease of insertion in a human body;

inserting the deformed primary product into the human body; and allowing the internal human body temperature to return the deformed primary product to the first configuration.

* * * * *

UNITED STATES PATENT AND TRADEMARK OFFICE

CERTIFICATE OF CORRECTION

PATENT NO. : 8,216,398 B2
APPLICATION NO. : 12/781017
DATED : July 10, 2012
INVENTOR(S) : John Gary Bledsoe It is certified that error appears in the above-identified patent and that said Letters Patent is hereby corrected as shown below:

In Col. 2, line 4, delete “foam” and replace with -- form --

In Col. 5, line 1, delete “defaulted” and replace with -- deformed --

Signed and Sealed this
Sixth Day of November, 2012

David J. Kappos

David J. Kappos
*Director of the United States Patent and Trademark Office*